US011661781B2

(12) United States Patent
Kikuchi

(10) Patent No.: US 11,661,781 B2
(45) Date of Patent: May 30, 2023

(54) HINGE, ACCOMMODATION DEVICE, AND REFRIGERATOR

(71) Applicant: Samsung Electronics Co., Ltd., Suwon-si (KR)

(72) Inventor: Manabu Kikuchi, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 354 days.

(21) Appl. No.: 16/772,743

(22) PCT Filed: Dec. 13, 2018

(86) PCT No.: PCT/JP2018/045820

§ 371 (c)(1),
(2) Date: Jun. 12, 2020

(87) PCT Pub. No.: WO2019/117236

PCT Pub. Date: Jun. 20, 2019

(65) Prior Publication Data

US 2020/0340279 A1 Oct. 29, 2020

(30) Foreign Application Priority Data

Dec. 14, 2017 (JP) ..... JP2017-239797

(51) Int. Cl.

| | |
|---|---|
| ***E05F 1/12*** | (2006.01) |
| ***E05D 3/16*** | (2006.01) |
| ***F25D 23/02*** | (2006.01) |

(52) U.S. Cl.

CPC ..... *E05F 1/1207* (2013.01); *E05D 3/16* (2013.01); *F25D 23/028* (2013.01); *E05Y 2900/31* (2013.01)

(58) Field of Classification Search

CPC ..... E05F 1/1207; E05F 1/1246; E05F 1/1253; E05F 1/12; E05D 3/16; E05Y 2900/31;

(Continued)

(56) References Cited

U.S. PATENT DOCUMENTS

| | | | |
|---|---|---|---|
| 6,374,459 | B1 | 4/2002 | Zetti |
| 7,886,407 | B2 | 2/2011 | Resnik et al. |

(Continued)

FOREIGN PATENT DOCUMENTS

| | | | |
|---|---|---|---|
| JP | 9-32407 | A | 2/1997 |
| JP | 2007-32174 | A | 2/2007 |
| JP | 2008-539346 | A | 11/2008 |

OTHER PUBLICATIONS

International Search Report dated Feb. 19, 2019 in connection with International Patent Application No. PCT/JP2018/045820, 1 page.

(Continued)

*Primary Examiner* — William L Miller

(57) ABSTRACT

The present invention relates to reliably performing an opening portion operation and a closing operation without using a cam and a member sliding on the cam, by including a body-side member fixed to a box body; a door-side member fixed to a door, a link mechanism connecting the body-side member to the door-side member, and a catch mechanism interposed between the link mechanisms, between the body-side member and the link mechanism, or between the door-side member and the link mechanism, and configured to bias the door-side member in a closing direction or an opening portion direction, wherein the catch mechanism includes a coil spring provided on one side of two members that are connected so as to be rotatable relative to each other through a shaft member, and a transfer arm configured to transfer an elastic restoring force of the coil spring to an other side of the two members, and the transfer arm is connected to be rotatable at a point spaced apart from the shaft member on the other side of the two members.

20 Claims, 11 Drawing Sheets

(58) Field of Classification Search
CPC .. F25D 23/028; F25D 23/10; F25D 2323/024; Y10T 16/547; Y10T 16/5476; Y10T 16/5383; Y10T 16/53832; Y10T 16/53833
USPC ..... 16/366, 370, 286–288; 312/405
See application file for complete search history.

(56) References Cited

U.S. PATENT DOCUMENTS

| | | | | |
|---|---|---|---|---|
| 7,987,558 | B2 * | 8/2011 | Beckmann | E05F 1/1253 16/366 |
| 8,225,459 | B2 * | 7/2012 | Waltemate | E05F 5/02 16/371 |
| 10,669,760 | B2 * | 6/2020 | Zetti | E05D 3/16 |
| 10,876,335 | B2 * | 12/2020 | Byun | E05D 5/0276 |
| 11,021,901 | B2 * | 6/2021 | Thielmann | E05D 11/0054 |
| 11,319,740 | B2 * | 5/2022 | Byun | E05F 3/20 |
| 11,377,889 | B2 * | 7/2022 | Zetti | E05D 3/16 |
| 2002/0002758 | A1 * | 1/2002 | Stura | E05D 3/16 16/287 |
| 2005/0177980 | A1 * | 8/2005 | Herper | E05F 5/006 16/366 |
| 2008/0276422 | A1 * | 11/2008 | Beckmann | E05D 11/0054 16/258 |
| 2010/0101052 | A1 * | 4/2010 | Waltemate | E05F 1/1261 16/297 |
| 2020/0056829 | A1 * | 2/2020 | Cai | E05F 1/1253 |
| 2021/0054670 | A1 * | 2/2021 | Lee | E05F 1/1253 |
| 2021/0238902 | A1 * | 8/2021 | Byun | E05F 3/20 |
| 2021/0364223 | A1 * | 11/2021 | Oh | E05F 5/02 |
| 2021/0364224 | A1 * | 11/2021 | Oh | F25D 23/028 |
| 2021/0372187 | A1 * | 12/2021 | Lee | E05F 3/20 |
| 2022/0034577 | A1 * | 2/2022 | Oh | E05D 7/12 |
| 2022/0034578 | A1 * | 2/2022 | Seo | F25D 23/028 |

OTHER PUBLICATIONS

Written Opinion of the International Searching Authority dated Feb. 19, 2019 in connection with International Patent Application No. PCT/JP2018/045820, 4 pages.

* cited by examiner

HINGE, ACCOMMODATION DEVICE, AND REFRIGERATOR

CROSS-REFERENCE TO RELATED APPLICATIONS

This application is a 371 of International Application No. PCT/JP2018/045820 filed on Dec. 13, 2018, which claims priority to Japanese Patent Application No. 2017-239797 filed on Dec. 14, 2017, the disclosures of which are herein incorporated by reference in their entirety.

BACKGROUND

1. Field

The present invention relates to a hinge, a storage apparatus, and a refrigerator.

2. Description of Related Art

A conventional hinge, as disclosed in Patent Document 1, includes a bracket mounted on a box body serving as a fixed object, a socket mounted on a door serving as a moving object, a link mechanism installed between the bracket and the socket mounted as above, and a catch mechanism configured to bias the socket in an opening direction and/or closing direction of the moving object.

The catch mechanism includes a cam provided on a link arm of the link mechanism adjacent to the socket and a cam follower arranged to slide in the socket and elastically biased toward the cam, and as the cam follower slides with respect to the cam, exerts a catch force.

However, with such a configuration in which the cam follower slides with respect to the cam, sliding surfaces of the cam follower and the cam are worn out, and deformed with the number of times the door is opened and closed. As a result, it is difficult to maintain the initial catch force.

Therefore, it is an object of the disclosure to provide a technology capable of reliably performing an opening portion operation and a closing operation without using a cam and a member sliding on the cam.

SUMMARY

A hinge according to the present invention includes: a body-side member fixed to a box body; a door-side member fixed to a door; a link mechanism connecting the body-side member to the door-side member; and a catch mechanism interposed in between the link mechanism, between the body-side member and the link mechanism, or between the door-side member and the link mechanism, and configured to bias the door-side member in a closing direction or an opening portion direction, wherein the catch mechanism includes a coil spring provided at one side of two members that are connected so as to be rotatable relative to each other through a shaft member, and a transfer arm configured to transfer an elastic restoring force of the coil spring to an other side of the two members, and the transfer arm is connected to be rotatable at a point spaced apart from the shaft member on the other side of the two members.

In the case of such a hinge, since the coil spring and the transfer arm bias the door-side member in the opening or closing direction according to the opening and closing of the door-side member, the opening or closing operation is performed without using the cam and the member sliding on the cam. As a result, the deterioration of the catch force due to abrasion that may occur by using a cam and a member sliding on the cam may be prevented.

In a specific embodiment of the catch mechanism, preferably, the catch mechanism biases the door-side member in the closing direction when the door-side member is in a closed state with respect to a predetermined rotation angle, and biases the door side member in the opening direction when the door-side member is in an open state with respect to the predetermined rotation angle.

Preferably, the link mechanism includes a link member rotatably connected to the door side member through a shaft member, the coil spring is provided on the door-side member, and the transfer arm is rotatably connected to the link member. With such a configuration, the catch mechanism is provided at a door side of the hinge, so that the catching ability of the catch mechanism may be reliably exhibited, and the airtightness of the door may be improved.

Preferably, the coil spring is accommodated in an accommodating portion provided in the door side member.

With such configuration, an injury caused by an accidental contact with a coil spring or a foreign object stuck in the coil spring may be prevented.

In order to apply the catch force in the opening or closing direction while simplifying the movement of the transfer arm, preferably, the transfer arm has one end portion connected with respect to the accommodating portion so as to be slidable along a straight line, and has an other end portion rotatably connected to the link member. Moreover, the elastic restoring force of the coil spring may be appropriately used by allowing the slide direction of the one end of the transfer arm to match the extension and contraction direction of the coil spring.

Then, in order to reliably apply the catch force when the door-side member is in a closed or open state with respect to the predetermined rotation angle, compression deformation of the coil spring is set to be maximized when the door-side member is at the predetermined rotation angle. In this state, the direction of the elastic restoring force applied to the link member from the other end of the transfer arm passes through the central axis of the shaft member.

The accommodating portion is provided with a slide body that slides according to extension and contraction of the coil spring, and the one end of the transfer arm is connected to the slide body. With such a configuration, the dimensions of the transmission arm may be designed regardless of the winding diameter of the coil spring.

When the link mechanism is provided as a multi-axis link, the door may be moved forward from the box body when the door is opened. As a result, even in the case in which the storage apparatus is integrally built-in to the storage space of a kitchen or accommodated in storage furniture for use, when the door is opened, the edge portion of the door on the hinge side is not easily brought into contact with an adjacent wall, so that the door may be completely opened.

A storage apparatus according to the present invention includes a box body having an opening portion at a front side thereof, a door configured to open and close the opening portion, and a hinge rotatably supporting the door with respect to the box body, wherein the hinge has a configuration described above.

A refrigerator includes the storage apparatus and a refrigeration cycle for cooling inside of the box body.

According to the present invention, an opening portion operation and a closing operation can be reliably performed without using a cam and a member sliding on the cam.

DETAILED DESCRIPTION

Hereinafter, an embodiment of a refrigerator configured using a storage apparatus according to the present invention will be described with reference to the drawings.

Figure 1:
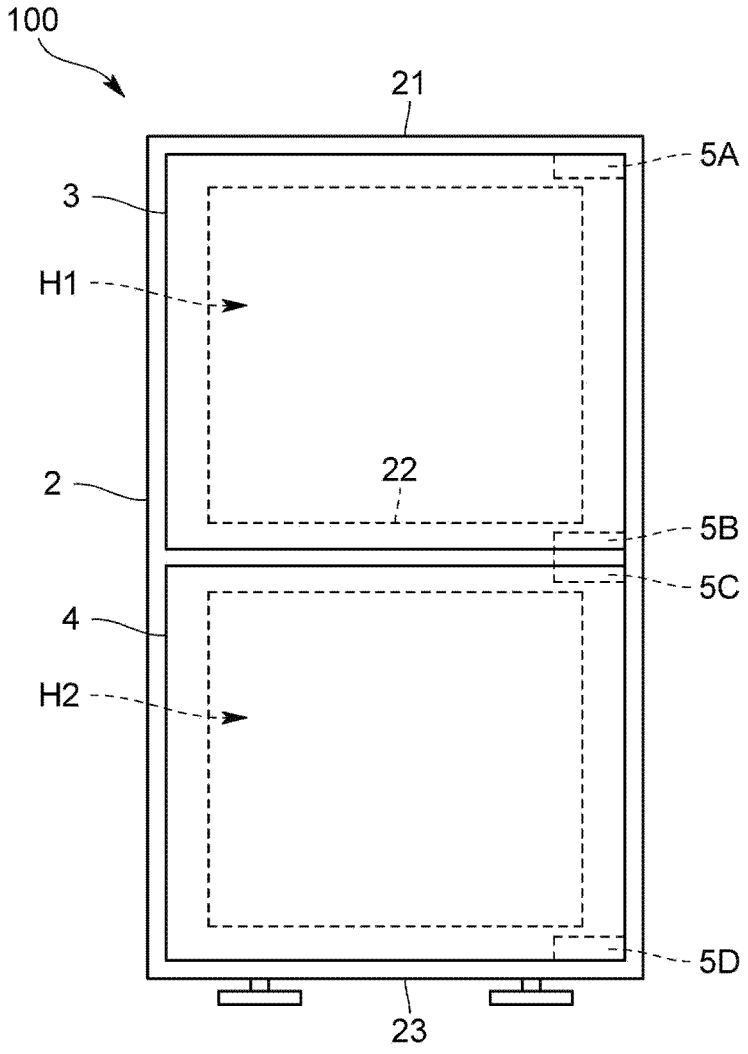
FIG. 1 is a block diagram illustrating a refrigerator according to the embodiment.

Referring to FIG. 1, a refrigerator 100 according to the embodiment, includes a refrigerator body 2 provided as a box body having at a front thereof with an upper opening portion H1 and a lower opening portion H2 divided by a partial wall 22, an upper door 3 for opening and closing the upper opening portion H1, a lower door 4 for opening and closing the lower opening portion H2, and a hinge 5 rotatably supporting the upper door 3 and the lower door 4 with respect to the refrigerator body 2. The interior space of the refrigerator body 2 is cooled by a refrigeration cycle constructed by connecting a compressor, a condenser, a decompression device, and a cooler to each other through piping.

In addition, the hinge 5 includes a pair of multi-axis hinges 5A and 5B provided on the upper and lower sides of the upper door 3 and a pair of multi-axis hinges 5C and 5D provided on the upper and lower sides of the lower door 4. The multi-axis hinges 5A to 5D are provided on a front portion of the refrigerator body 2. The multi-axis hinge 5A provided on the upper side of the upper door 3 is installed on an upper wall portion 21 of the refrigerator body 2, and the multi-axis hinge 5B provided on the lower side of the upper door 3 is installed on the partition wall 22. In addition, the multi-axis hinge 5C provided on the upper side of the lower door 4 is installed on the partial wall 22, and the multi-axis hinge 5D provided on the lower side of the lower door 4 is installed on a lower wall portion 23 of the refrigerator body 2.

In detail, referring to FIGS. 2 to 5, the multi-axis hinges 5A to 5D are provided with a body-side member 51 fixed to the refrigerator body 2, a door-side member 52 fixed to the upper door 3 or the lower door 4, and a link mechanism 53 that connects the body-side member 51 to the door-side member 52 so as to be displaceable relative to each other. The four multi-axis hinges have the same rotational trajectory. Hereinafter, the multi-axis hinge 5B provided on the lower side of the upper door 3 and the multi-axis hinge 5C provided on the upper side of the lower door 4 will be described with reference to FIGS. 2 to 5, but other multi-axis hinges 5A and 5D also have the same basic configuration as those of the multi-axis hinges 5B and 5C.

Figure 2:
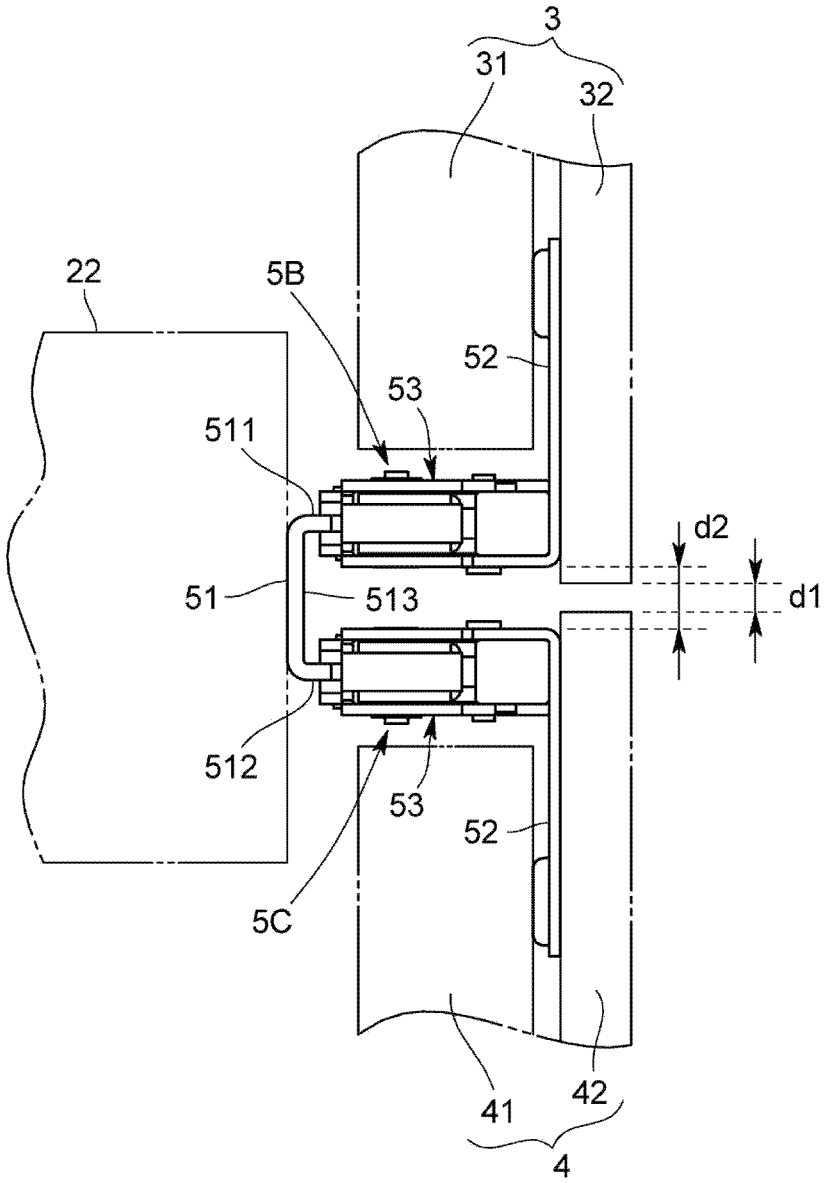
FIG. 2 is a side view of a hinge (two middle hinges) according to the present embodiment, which shows a state in which two middle hinges are in a closed position.

In the embodiment, the door-side member 52 has one side surface (an inner surface) which faces the link mechanism 53 and to which the door body 31 or 41 formed of an insulating member of the upper door 3 or the lower door 4 is fixed, and has the other side surface (an outer surface) which faces away from the link mechanism 53 and to which a design panel 32 or 42 is fixed (see FIG. 2).

The link mechanism 53 is a seven-section link mechanism, and includes a plurality of links L1 to L4 (first to fourth links) and a plurality of shaft members P1 to P7 rotatably connecting the plurality of links L1 to L4.

One end portion of the first link L1 is connected to the body-side member 51 by the first shaft member P1, and the other end portion of the first link L1 is connected to one end portion of the second link L2 by the second shaft member P2. The other end portion of the second link L2 is connected to the door-side member 52 by the third shaft member P3.

In addition, one end portion of the third link L3 is connected to the body-side member 51 by the fourth shaft member P4, and the other end portion of the third link L3 is connected to the second link L2 by the fifth shaft member P5. In the second link L2, the position where the other end portion of the third link L3 is connected to the second link L2 is more adjacent to the other end portion of the second link L2 (inner side) relative to the position where the other end portion of the first link L1 is connected to the second link L2.

In addition, one end portion of the fourth link L4 is connected to the third link L3 by the sixth shaft member P6. In the third link L3, the position where the one end portion of the fourth link L4 is connected to the third link L3 is more adjacent to the one end portion of the third link L3 (inner side) relative to the position where third link L3 is connected to the one end portion of the second link L2. The other end portion of the fourth link L4 is connected to the door-side member 52 by the seventh shaft member P7.

With the link mechanism 53, the door 3 or and 4 is configured to rotate between a closing position for closing the opening portion H1 or H2 and an opening position for opening the opening portion H1 or H2, and while rotating from the closing position to the opening portion position, have a hinge side corner thereof spaced apart from the refrigerator body 2.

In addition, the two multi-axis hinges 5B and 5C located between the upper door 3 and the lower door 4 among the plurality of multi-axis hinges 5A to 5D (hereinafter, also referred to as "middle hinges 5B and 5C") use the body-side member 51 in common.

The body-side member 51 used in common (hereinafter, also referred to as "a common member Si") includes an upper protrusion 511 having a flat plate shape and to which the link mechanism 53 of the multi-axis hinge 5B provided on the lower side of the upper door 3 is connected and a lower protrusion 512 having a flat plate shape and to which the link mechanism 53 of the multi-axis hinge 5C provided on the upper side of the lower door 4 is connected. In the embodiment, a cross section including the protrusions 511 and 512 is formed in a substantially 'U' shape, and an intermediate portion 513 between the upper protrusion 511 and the lower protrusion 512 is screwed to the refrigerator body 2 (specifically, a front portion of the partition wall 22).

The common member 51 is formed by integrally forming the upper protrusion 511, the lower protrusion 512, and the intermediate portion 513 with each other.

In addition, in the embodiment, with regard to the two middle hinges 5B and 5C, components except for the door-side member 52, specifically, the common member 51 and the link mechanism 53 are each configured to be vertically symmetrical. Further, with regard to the two middle hinges 5B and 5C components except for the common member 51 and the door-side member 52, specifically, the links L1 to L4 of the link mechanism 53 and the shaft members P1 to P7 of the link mechanism 53 have the same shape between the two middle hinges 5B and 5C. In addition, in the present embodiment, the two middle hinges 5B and 5C are each configured to be mounted to be bilaterally symmetrical on the refrigerator body 2.

The strength of the two middle hinges 5B and 5C configured as described above is configured to be smaller than the strength of the multi-axis hinge 5A provided on the upper side of the upper door 3 and the multi-axis hinge 5D provided on the lower side of the lower door 4. With such a configuration, most of the load of the upper door 3 is supported by the multi-axis hinge 5A provided on the upper side of the upper door 3, and most of the load of the lower door 4 is supported by the multi-axis hinge 5D provided on the lower side of the lower door 4. As a result, the two middle hinges 5B and 5C do not need to have a great strength, so that the two middle hinges 5B and 5C may be reduced in thickness and the partition wall 22 may be reduced in thickness, causing the internal capacity to be increased.

In addition, as shown in FIG. 2, a distance d1 between the design panels 32 and 42 fixed to the door-side members 52 of the two middle hinges 5B and 5C is set to be smaller than a distance d2 between the door-side members 52 of the two middle hinges 5B and 5C. With this configuration, a position adjusting handle in the vertical direction of the design panels 32 and 42 with respect to the door-side member 52.

Figure 3:
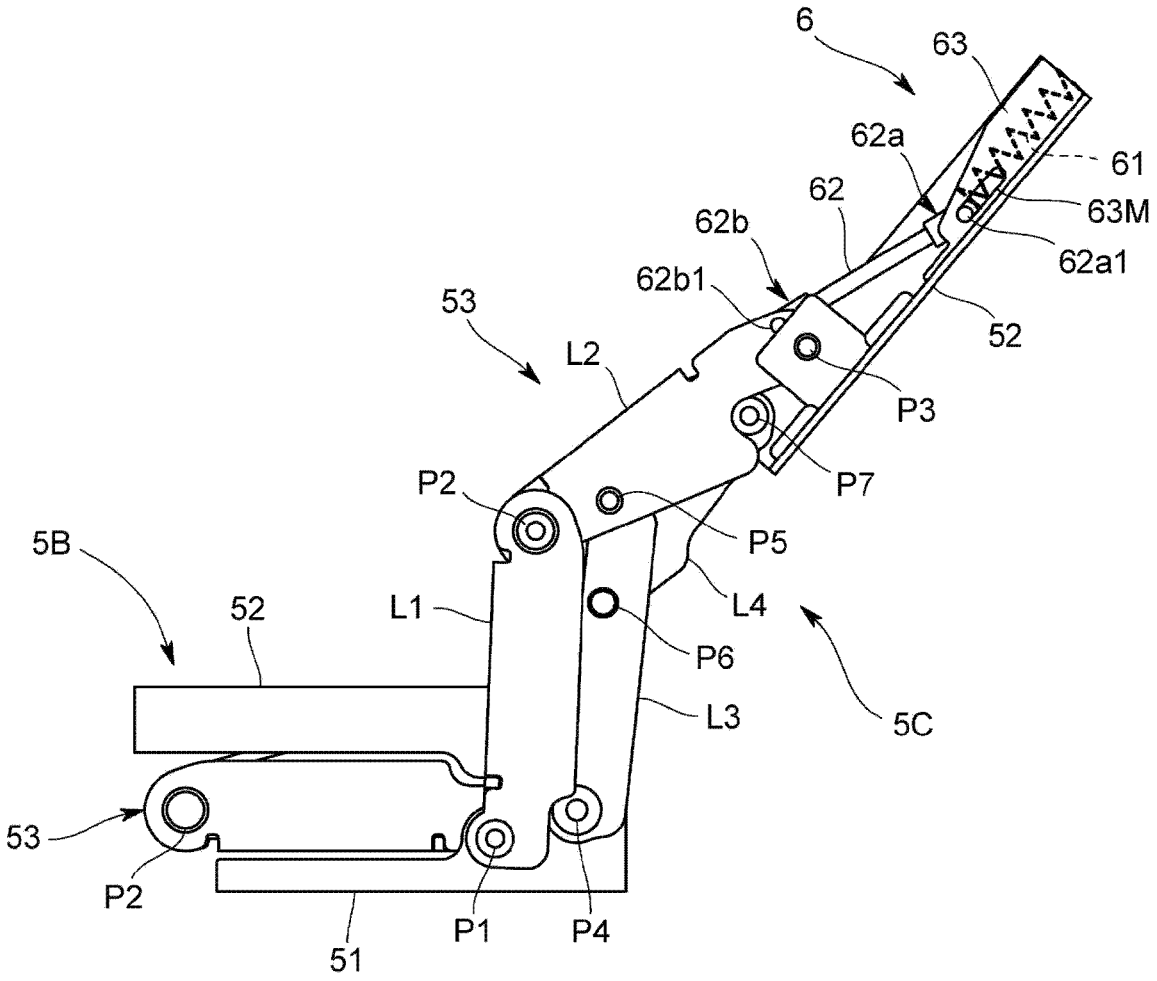
FIG. 3 is a bottom view of a hinge (two middle hinges) according to the present embodiment, which shows a state in which one of the middle hinges (a middle hinge 5C) is in an open position.
Figure 4:
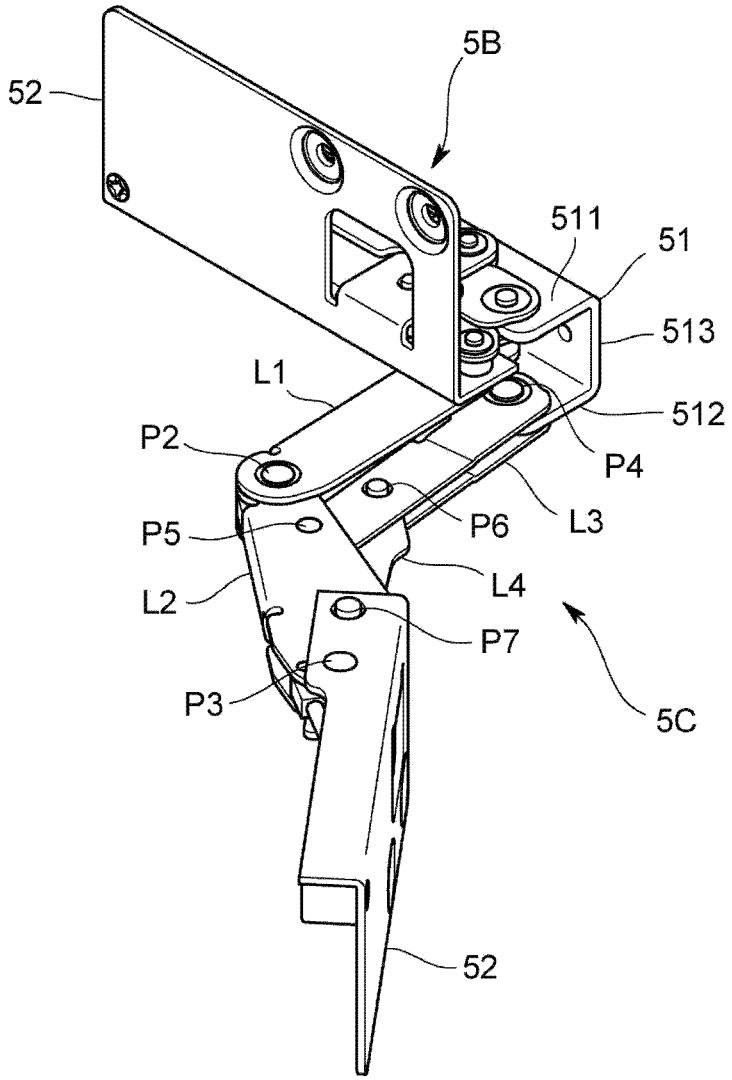
FIG. 4 is a perspective view of a hinge (two middle hinges) according to the present embodiment, which shows a state in which one of the middle hinges (a middle hinge 5C) is in an open position.
Figure 5:
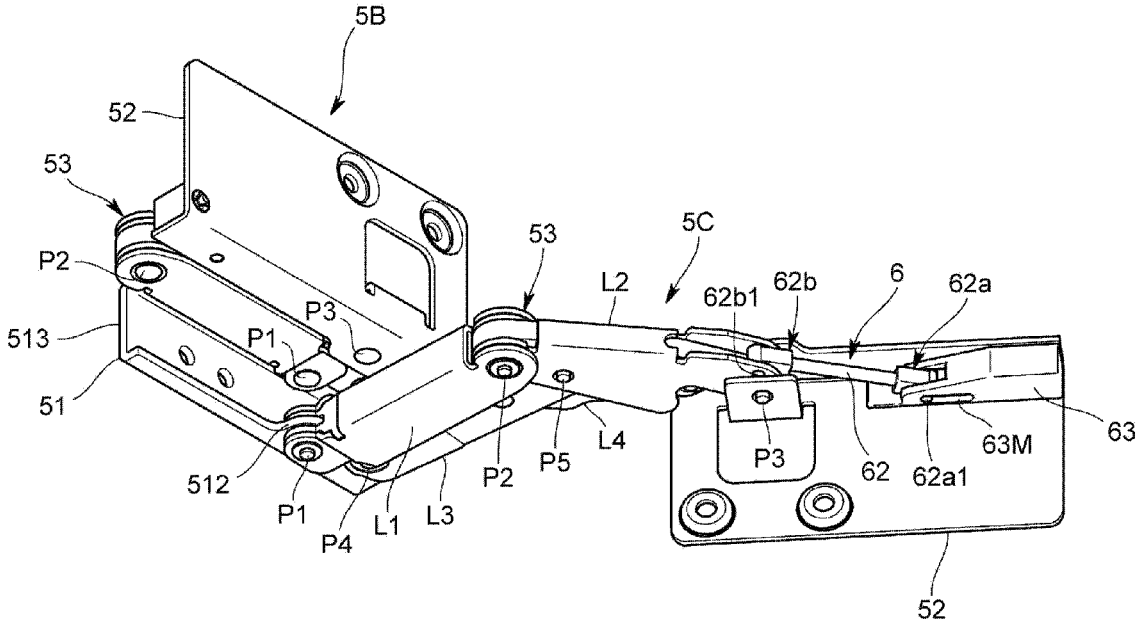
FIG. 5 is a perspective view of a hinge (two middle hinges) according to the present embodiment, which shows a state in which one of the middle hinges (a middle hinge 5C) is in an open position.
Figure 7:
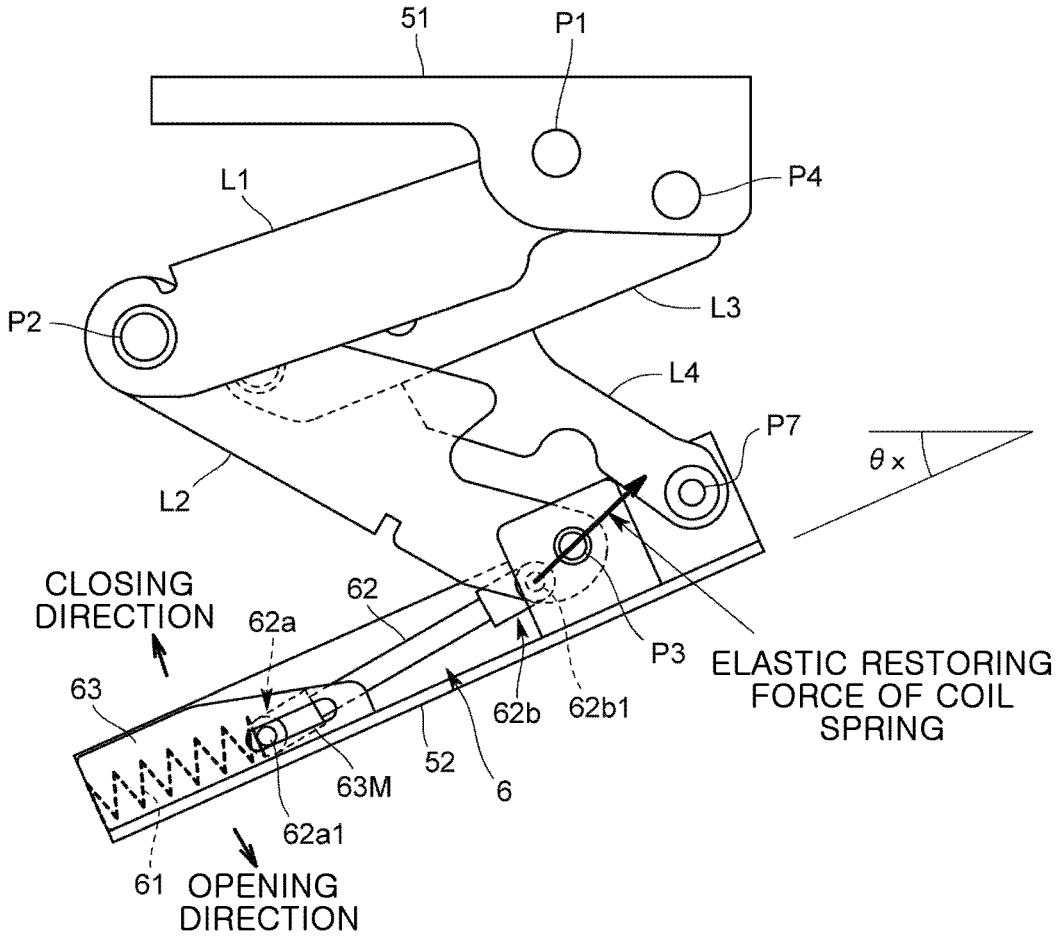
FIG. 7 is a schematic view illustrating a state in which a door-side member is positioned at a predetermined rotation angle $\theta_X$ according to the present embodiment.

In addition, referring to FIGS. 3, 4, and 7, the hinge 5 according to the present embodiment further includes a catch mechanism 6 provided between the door-side member 52 and the link mechanism 53 and configured to bias the door-side member 52 in the closing direction and the opening direction.

Specifically, the catch mechanism 6 includes a coil spring 61 provided at one side of two members connected to be rotatable relative to each other through a shaft member, and a transfer arm 62 for transmitting an elastic restoring force of the coil spring 61 to the other side of the two members. In the embodiment, the two members include the door-side member 52 and the second link L2 connected to each other by the third shaft member P3.

The coil spring 61 is provided on one side of the door-side member 52 opposite to a side on which the door (the upper door 3 or the lower door 4) is mounted, and in the embodiment, the coil spring 61 is accommodated in an accommodating portion 63 provided on the door-side member 52.

The accommodating portion 63 extends in a direction perpendicular to the rotation axis of the third shaft member P3. In addition, the coil spring 61 accommodated in the accommodating portion 63 expands and contracts in the direction perpendicular to the rotation axis of the third shaft member P3.

The transfer arm 62 is provided in the form of a straight line, and has one end portion 62*a* connected to the door-side member 52 and the other end portion 62*b* connected to the second link L2.

The one end portion 62*a* of the transfer arm 62 is connected to be rotatable and slidable along a straight line with respect to the accommodation portion 63. Here, the one end portion 62*a* is slidable along a slide groove 63 formed in the accommodation portion 63. Specifically, the one end portion 62*a* is provided with a slide portion 62*a*1 that slides in the slide groove 63. Accordingly, the slide direction of the one end portion 62*a* of the transfer arm 62 coincides with the extension and contraction direction of the coil spring 61.

In addition, the other end portion 62*b* of the transfer arm 62 is rotatably connected at a position spaced apart from the third shaft member P3 in the second link L2. Specifically, the other end portion 62*b* is provided to be rotatable by a connecting pin 62*b*1.

Therefore, as shown in FIG. 7, the catch mechanism 6 biases the door-side member 52 in the closing direction when the door-side member 52 is in a closed state with respect to a predetermined rotation angle $\theta_X$, and biases the door-side member 52 in the opening direction when the door-side member 52 is in an open state with respect to the predetermined rotation angle $\theta_X$. Here, the predetermined rotation angle $\theta_X$ is an angle where the direction of the elastic restoring force of the coil spring 61 applied to the second link L2 from the other end portion 62*b* (specifically, the connecting pin 62*b*1) of the transfer arm 62 passes through the rotation axis of the third shaft member P3. Further, in this state, the compression deformation of the coil spring 61 is maximized.

Then, when the door-side member 52 is in a closed state with respect to the predetermined rotation angle $\theta_X$, an elastic restoring force of the coil spring 61 applied to the second link L2 from the other end portion 62*b* of the transfer arm 62 causes the second link L2 to be subject to a rotational moment (torque) in the closing direction around the third shaft member P3. In the present embodiment, the rotational moment is applied in the closing direction until the door-side member 52 reaches an angle at which the door is set into a closed position from the predetermined rotation angle $\theta_X$.

On the other hand, when the door-side member 52 is in an open state with respect to the predetermined rotation angle $\theta_X$, an elastic restoring force of the coil spring 61 applied to the second link L2 from the other end portion 62*b* of the transfer arm 62 causes the second link L2 to be subject to a rotational moment (torque) in the opening direction around the third shaft member P3. In the embodiment, the rotational moment is applied in the opening direction until the door-side member 52 reaches an angle at which the door is set into an open position from the predetermined rotation angle $\theta_X$.

Advantageous Effects of the Present Embodiment

According to the refrigerator 100 of the present embodiment configured as described above, the coil spring 61 and the transfer arm 62 bias the door-side member 52 in the opening or closing direction according to the opening or closing of the door-side member 52. Therefore, an opening operation or closing operation may be performed without using a cam and a member sliding on the cam. As a result, the deterioration of the catch force due to abrasion caused when using a cam and a member sliding on the cam is prevented.

Further, since the catch mechanism 6 is provided between the door-side member 52 and the second link L2, the catch force of the catch mechanism 6 may be reliably exhibited, so that sealing performance of the doors 3 and 4 may be improved.

In addition, the catch mechanism 6 is interposed between the door side member 52 and the second link L2, so that the catching ability of the catch mechanism 6 may be reliably exhibited, and the airtightness of the door may be improved.

In addition, since the coil spring 61 is accommodated in the accommodating portion 63 provided on the door side member 52, an injury caused by an accidental contact with the coil spring 61 or a foreign object stuck in the coil spring 61 may be prevented.

The one end portion 62*a* of the transfer arm 62 is connected so as to be slidable along a straight line with respect to the accommodating portion 63, and the other end portion 62*b* of the transfer arm 62 is rotatably connected to the second link L2. Accordingly, the catch force is applied in the opening portion or closing direction while simplifying the movement of the transfer arm 62. In addition, since the slide direction of the one end portion 62*a* of the transfer arm 62 coincides with the extension and contraction direction of the coil spring 62, the elastic restoring force of the coil spring 61 may be suitably used.

Figure 6:
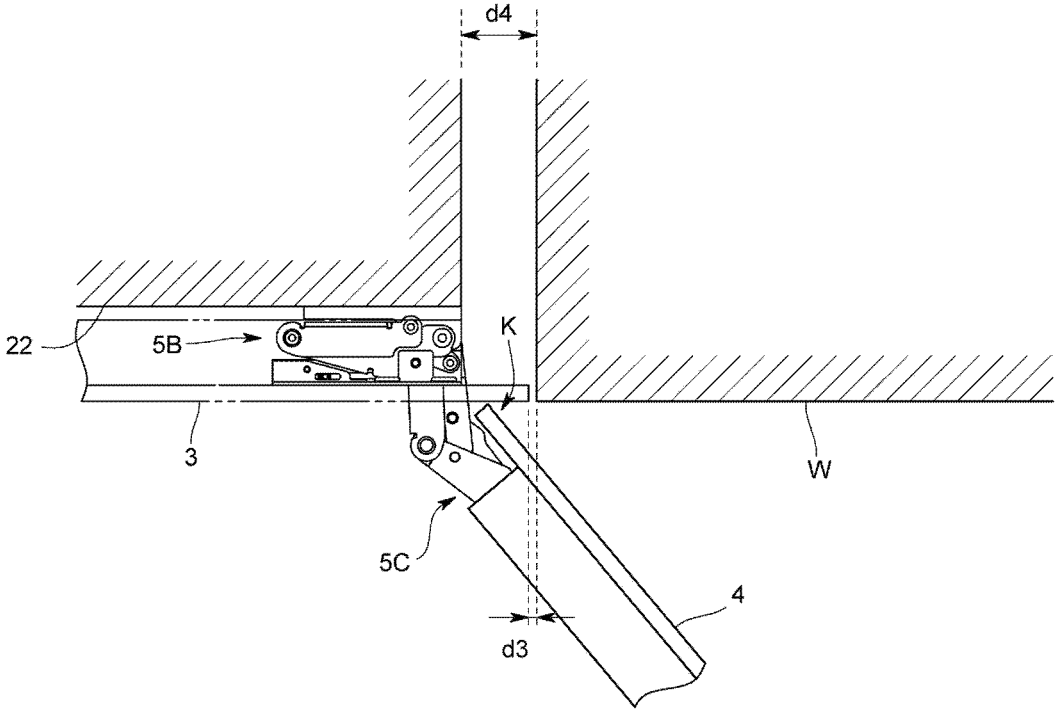
FIG. 6 is a schematic view illustrating a positional relationship between a door edge portion adjacent to a hinge and a wall in a state in which the door is open according to the preset embodiment.

Moreover, since the hinge 5 includes the multi-axis hinges 5A to 5D provided on the upper and lower sides of the doors 3 and 4, when the doors 3 and 4 are opened, the doors 3 and 4 are moved forward from the refrigerator body 2. As a result, even when the refrigerator 100 is integrally built-in with a storage space of a kitchen for use, or is accommodated in a storage furniture for use, a hinge side edge portion K of the door is not easily brought into contact with a wall W adjacent thereto even when the doors 3 and 4 are opened (see FIG. 6), so that the doors 3 and 4 may be sufficiently opened. Here, in a state in which the upper door 3 or the lower door 4 is closed, the distance d3 between the design panels 32 and 42 and an inner side of the wall W corresponds to the distance between the refrigerator 100 and the wall W, so that it is preferable to increase the distance d4 between the refrigerator main body 2 and the inner side of the wall W in terms of heat dissipation.

The two middle hinges 5B and 5C use the body-side member 51 in common, so that the partition wall 22 is reduced in thickness, and the internal capacity of the body is prevented from being reduced compared to a refrigerator of the same height. In addition, since the body-side member 51 is used in common by the two middle hinges 5B and 5C, even when the thickness of the two middle hinges 5B and 5C is thin, the mechanical strength of the common body-side member 51 is secured.

In the common body-side member 51, since the intermediate portion 513 between the upper protrusion 511 and the lower protrusion 512 is configured to be fixed to the refrigerator body 2, the mechanical strength of the body-side member 51 is secured while the installation space in the refrigerator body 2 is reduced. In addition, since the upper protrusion 511 and the lower protrusion 512 to which the link mechanism 53 is connected has a flat plate shape, the thickness of the two middle hinges 5B and 5C may be reduced.

Modified Embodiments

Here, the present invention is not limited to the above embodiment.

For example, the catch mechanism may be a configuration provided in between the link mechanism or between the body-side member and the link mechanism.

Although the coil spring is provided on the door-side member in terms of installation space and the like in the above embodiment, the coil spring may be provided on the link member, such as the second link.

Further, the catch mechanism may have an adjustment mechanism that adjusts the elastic restoring force of the coil spring. As an example, the adjustment mechanism may be a screw that is screwed to reciprocate with respect to the accommodation portion, and the screw causes the coil spring to be deformed in the extension and contraction direction so that the elastic restoring force is adjusted.

Figure 9:
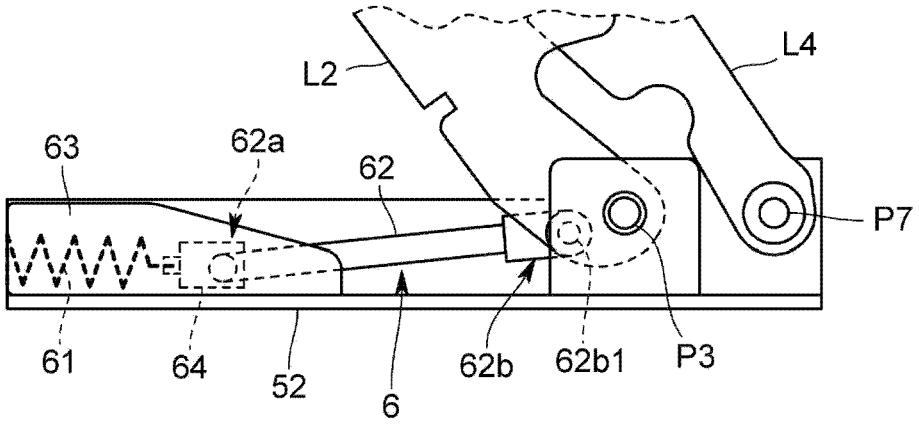
FIG. 9 and FIG. 10 are schematic views illustrating a modified example of a catch mechanism.

Although the transfer arm 62 is provided at the one end portion 62*a* with the slide portion 62*a*1 in the above embodiment, the accommodating portion 63 as illustrated in FIG. 9 may be provided at an inside thereof not only with the coil spring 61 but also with a slide body 64 that slides according to extension and contraction of the coil spring 61 such that the one end portion 62*a* of the transfer arm 62 is connected to the slide body 64. With such a configuration, the dimensions of the transfer arm 62 may be designed regardless of the winding diameter of the coil spring 61.

Figure 10:
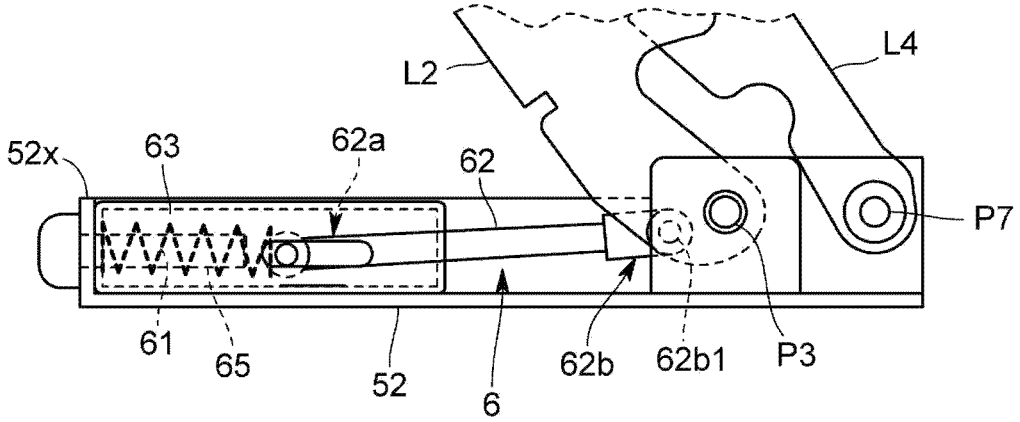

Referring to FIG. 10, the accommodating part 63 of the catch mechanism may be a configuration that is screwed to a tip bending portion 52*x* of the window side member 52. In this case, a fixing screw 65 fixing the accommodating part 63 protrudes inside the accommodating part 63, and allows the protruding portion to serve as a guide portion of the coil spring 61. Accordingly, the fixing screw 65 may serve to fix the accommodating portion 63 while guiding the coil spring 61.

In addition, although the link mechanism according to the above embodiment is a seven-section link mechanism, the link mechanism may be implemented as other multi-section link mechanisms.

In addition, although the hinge according to the above embodiment uses the body-side member in common for the two middle hinges, separate body-side members may be provided. In addition, when the body-side member of the two middle hinges is used in common, the main body-side member may be composed of different, plural parts composed of single members.

In addition, although the common member according to the above embodiment has a cross section including the protruding portions that is illustrated as having a substantially "U" shape, the shape of the common member is not limited thereto.

Moreover, although the two middle links according to the above embodiment use the first shaft member and the fourth shaft member respectively for each link, the two middle links may compose the first shaft member as a common-use member, or compose the fourth shaft member as a common-use member. In this case, the common-use members are provided over the upper and lower protrusions of the common member.

With respect to a closing face of the door, in order to easily secure a portion sealing an opening portion, the door is preferably provided with the hinge 5 on a side different from a side having the closing face closing the opening portion. That is, the door-side member 52 of the hinge 5 is mounted on a side different from a side having the closing face of the door 3 or 4.

Figure 8A:
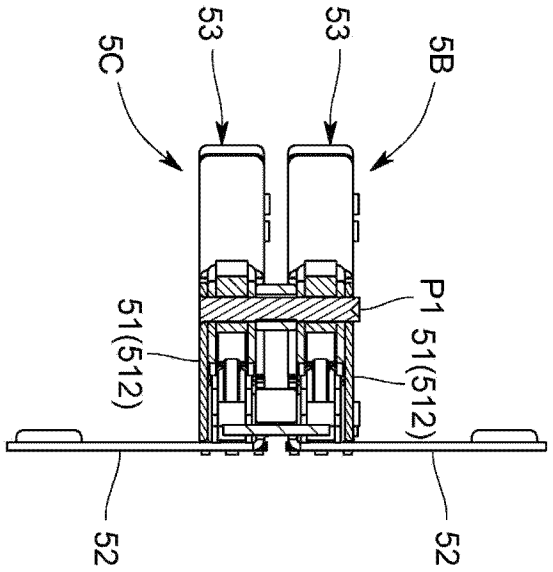
FIG. 8*a* and FIG. 8*b* show a plan view of a hinge in an open position according to a modified embodiment and a cross-sectional view taken along line A-A of the hinge.
Figure 8B:
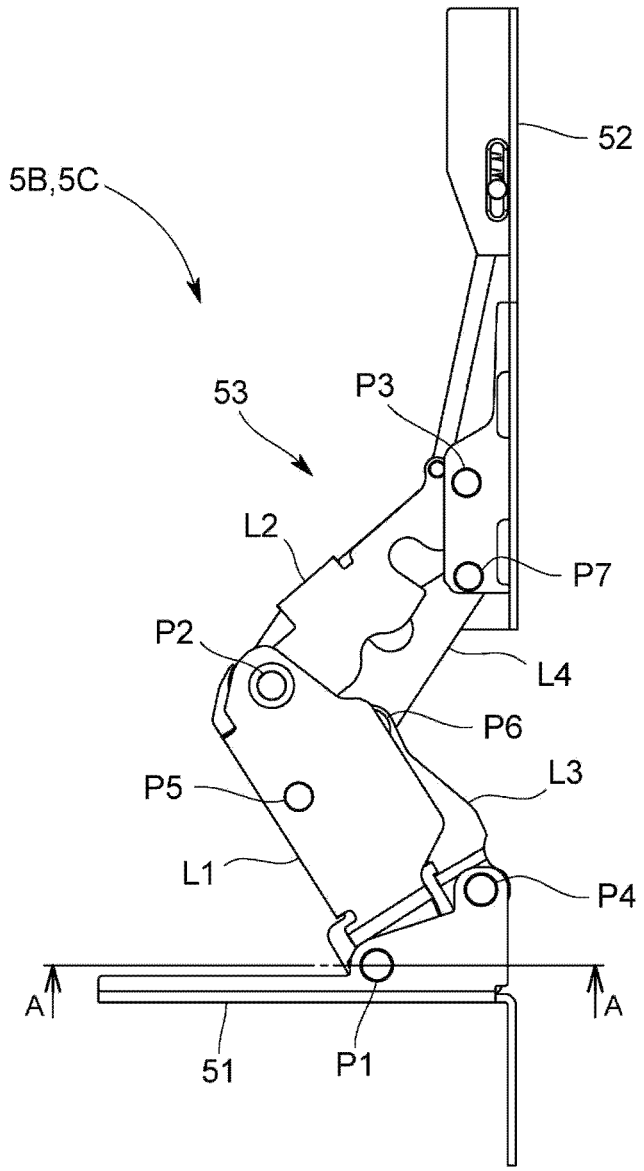

Although the two middle hinges 5B and 5C according to the above embodiment are connected to the body-side member 51 by separate shaft members, the first shaft member P1 of the middle hinge 5B and the first shaft member P1 of the middle hinge 5C may be provided as a common shaft member as shown in FIG. 8. Moreover, similarly, the fourth shaft member P4 of the middle hinge 5B and the fourth shaft member P4 of the middle hinge 5C may also be provided as a common shaft member. With such a configuration, the number of parts of the shaft members may be reduced. In addition, although the structure of the link mechanism 53 of FIG. 8 is slightly different from that of the link mechanism 53 of the above embodiment, the operations are the same as each other.

Although the above embodiment has been described on a multi-axis hinge as an example, the hinge may be provided as a single-axis hinge.

Although the above embodiment has been described on a refrigerator using a storage apparatus, the present invention is not limited to the refrigerator, and may be applicable to other storage apparatuses.

In addition, the present invention is not limited to the above embodiment, and various modifications are possible without departing from the spirit.

INDUSTRIAL APPLICABILITY

According to the present invention, the opening or closing operation may be reliably performed without using a cam and a member sliding on the cam.

The invention claimed is:

1. A hinge comprising:

a body-side member fixed to a box body;

a door-side member fixed to a door;

a link mechanism including a plurality of link members connecting the body-side member to the door-side member; and a catch mechanism interposed between two members among one of the plurality of link members, the body-side member, and the door-side member, and configured to apply a rotational force to the door-side member in a closing direction or an opening direction, wherein the catch mechanism includes a coil spring having one end portion thereof fixed to one side of one of the two members that are connected so as to be rotatable relative to each other through a shaft member, and a transfer arm configured to transfer an elastic restoring force of the coil spring to a remaining one of the two members, and the transfer arm has one end portion thereof connected to an other end portion of the coil spring and an other end portion thereof rotatably connected to the remaining one of the two members.

2. The hinge of claim 1, wherein the catch mechanism is configured to apply an elastic force to the door-side member in the closing direction when the door-side member is in a closed state with respect to a predetermined rotation angle, and apply an elastic force to the door-side member in the opening direction when the door-side member is in an open state with respect to the predetermined rotation angle.

3. The hinge of claim 1, wherein the transfer arm has the other end portion thereof connected at a position spaced apart from the shaft member in the remaining one of the two members so as to be rotatable on a rotating axis formed in parallel with the shaft member.

4. The hinge of claim 3, wherein the coil spring is accommodated in an accommodating portion provided in the one of the two members.

5. The hinge of claim 4, wherein the transfer arm has the one end portion connected so as to be slidable along a straight line with respect to the accommodating portion, and when one of the two members is positioned at a predetermined angle, the coil spring is maximally compressed and deformed.

6. The hinge of claim 5, wherein the accommodating portion is provided with a slide body that slides according to extension and contraction of the coil spring, and the one end portion of the transfer arm is connected to the slide body.

7. The hinge of claim 1, wherein the link mechanism is a multi-axis link.

8. A storage apparatus comprising:

a box body having an opening portion at a front side thereof;

a door configured to open and close the opening portion; and a hinge rotatably supporting the door with respect to the box body, wherein the hinge comprises:

a body-side member fixed to the box body;

a door-side member fixed to the door;

a link mechanism including a plurality of link members connecting the body-side member to the door-side member; and a catch mechanism interposed between two members among one of the plurality of link members, the body-side member, and the door-side member, and configured to apply a rotational force to the door-side member in a closing direction or an opening direction, wherein the catch mechanism includes a coil spring having one end portion thereof fixed to one side of one of the two members that are connected so as to be rotatable relative to each other through a shaft member, and a transfer arm configured to transfer an elastic restoring force of the coil spring to a remaining one of the two members, and the transfer arm has one end portion thereof connected to an other end portion of the coil spring and an other end portion thereof rotatably connected to the remaining one of the two members.

9. The storage apparatus of claim 8, wherein the catch mechanism is configured to apply an elastic force to the door-side member in the closing direction when the door-side member is in a closed state with respect to a predetermined rotation angle, and apply an elastic force to the door-side member in the opening direction when the door-side member is in an open state with respect to the predetermined rotation angle.

10. The storage apparatus of claim 8, wherein the transfer arm has the other end portion thereof connected at a position spaced apart from the shaft member in the remaining one of the two members so as to be rotatable on a rotating axis formed in parallel with the shaft member.

11. The storage apparatus of claim 10, wherein the coil spring is accommodated in an accommodating portion provided in the one of the two members.

12. The storage apparatus of claim 11, wherein the transfer arm has the one end portion connected so as to be slidable along a straight line with respect to the accommodating portion, and when one of the two members is positioned at a predetermined angle, the coil spring is maximally compressed and deformed.

13. The storage apparatus of claim 12, wherein the accommodating portion is provided with a slide body that slides according to extension and contraction of the coil spring, and the one end portion of the transfer arm is connected to the slide body.

14. The storage apparatus of claim 8, wherein the link mechanism is a multi-axis link.

15. A refrigerator comprising:

a box body having an opening portion at a front side thereof;

a door configured to open and close the opening portion;

a refrigeration cycle configured to cool an inside of the box body; and a hinge rotatably supporting the door with respect to the box body, wherein the hinge comprises:

a body-side member fixed to the box body;

a door-side member fixed to the door;

a link mechanism including a plurality of link members connecting the body-side member to the door-side member; and a catch mechanism interposed between two members among one of the plurality of link members, the body-side member, and the door-side member, and configured to apply a rotational force to the door-side member in a closing direction or an opening direction, wherein the catch mechanism includes a coil spring having one end portion thereof fixed to one side of one of the two members that are connected so as to be rotatable relative to each other through a shaft member, and a transfer arm configured to transfer an elastic restoring force of the coil spring to a remaining one of the two members, and the transfer arm has one end portion thereof connected to an other end portion of the coil spring and an other end portion thereof rotatably connected to the remaining one of the two members.

16. The refrigerator of claim 15, wherein the catch mechanism is configured to apply an elastic force to the door-side member in the closing direction when the door-side member is in a closed state with respect to a predetermined rotation angle, and apply an elastic force to the door-side member in the opening direction when the door-side member is in an open state with respect to the predetermined rotation angle.

17. The refrigerator of claim 15, wherein the transfer arm has the other end portion thereof connected at a position spaced apart from the shaft member in the remaining one of the two members so as to be rotatable on a rotating axis formed in parallel with the shaft member.

18. The refrigerator of claim 17, wherein the coil spring is accommodated in an accommodating portion provided in the one of the two members.

19. The refrigerator of claim 18, wherein the transfer arm has the one end portion connected so as to be slidable along a straight line with respect to the accommodating portion, and when one of the two members is positioned at a predetermined angle, the coil spring is maximally compressed and deformed.

20. The refrigerator of claim 19, wherein the accommodating portion is provided with a slide body that slides according to extension and contraction of the coil spring, and the one end portion of the transfer arm is connected to the slide body.

* * * * *